US009206377B1

(12) United States Patent
Warren

(10) Patent No.: US 9,206,377 B1
(45) Date of Patent: Dec. 8, 2015

(54) SOLID LUBRICANT BLENDS FOR USE IN LUBRICATING COMPOSITIONS

(71) Applicant: Leonard P. Warren, Seymour, TN (US)

(72) Inventor: Leonard P. Warren, Seymour, TN (US)

( * ) Notice: Subject to any disclaimer, the term of this patent is extended or adjusted under 35 U.S.C. 154(b) by 21 days.

(21) Appl. No.: 14/068,250

(22) Filed: Oct. 31, 2013

Related U.S. Application Data

(63) Continuation-in-part of application No. 13/775,573, filed on Feb. 25, 2013, now abandoned.

(51) Int. Cl.

| | |
|---|---|
| ***C10M 125/22*** | (2006.01) |
| ***C10M 125/20*** | (2006.01) |
| ***C10M 125/18*** | (2006.01) |
| ***C10M 169/04*** | (2006.01) |

(52) U.S. Cl.
CPC ..... *C10M 169/04* (2013.01); *C10M 2201/041* (2013.01); *C10M 2201/06* (2013.01); *C10M 2201/061* (2013.01); *C10M 2201/066* (2013.01); *C10M 2205/0206* (2013.01); *C10M 2207/2835* (2013.01); *C10M 2207/2895* (2013.01); *C10N 2220/082* (2013.01); *C10N 2230/06* (2013.01); *C10N 2230/08* (2013.01); *C10N 2250/12* (2013.01)

(58) Field of Classification Search
CPC ..... C10M 169/04; C10M 2201/06; C10M 2201/061; C10M 2201/066; C10M 2201/041; C10M 2205/0206; C10M 2207/2835; C10M 2207/2895; C10N 2220/082; C10N 2230/06; C10N 2230/08; C10N 2250/12
USPC ..... 508/125, 169, 156, 155
See application file for complete search history.

(56) References Cited

U.S. PATENT DOCUMENTS

| | | | | |
|---|---|---|---|---|
| 5,037,564 | A * | 8/1991 | Nishizaki et al. | 508/450 |
| 6,390,682 | B1 | 5/2002 | McMeekin et al. | |
| 6,933,264 | B2 * | 8/2005 | Petelot | 508/318 |
| 6,960,555 | B2 | 11/2005 | Anthony et al. | |
| 7,091,161 | B2 | 8/2006 | Oldiges, Jr. et al. | |
| 7,294,608 | B2 | 11/2007 | Oldiges et al. | |
| 7,505,564 | B2 | 3/2009 | Anand et al. | |
| 7,510,760 | B2 | 3/2009 | Malshe et al. | |
| 2003/0119681 | A1 | 6/2003 | Patel et al. | |
| 2008/0145554 | A1 * | 6/2008 | Ghasripoor et al. | 427/450 |
| 2010/0167968 | A1 * | 7/2010 | Pinel et al. | 508/100 |
| 2011/0285124 | A1 * | 11/2011 | Pinel et al. | 285/94 |

OTHER PUBLICATIONS

"The Effect of Counterface on the Tribological Performance of a High Temperature Solid Lubricant Composite From 25 to 650 degrees C", Christopher DellaCorte, National Aeronautics and Space Administration, Lewis Research Cneter, US Department of Energy, 1996, 16 pages.
"Solid Lubricants / Dry Lubrication", http://www.tribology-abc.com/abc/solidlub.htm, Nov. 14, 2012.
U.S. Appl. No. 13/919,066, Jun. 17, 2013, Warren.
U.S. Appl. No. 14/333,718, Jul. 17, 2014, Warren.

* cited by examiner

*Primary Examiner* — James Goloboy
(74) *Attorney, Agent, or Firm* — Charles R. Wilson

(57) ABSTRACT

A lubricity enhancer at extreme temperatures and pressures comprises a first stage solid lubricant selected from the group consisting of molybdenum disulfide, graphite, polytetrafluorethylene and mixtures thereof, a second stage solid lubricant selected from the group consisting of boron nitride, tungsten disulfide and mixtures thereof, and a third stage solid lubricant of an inorganic fluoride characterized by being capable of forming a bonded substantially homogeneous film on a substrate at the elevated temperatures and pressures. The solid lubricants are blended in a concentrated form with a liquid carrier to form a lubricant additive concentrate for addition to a base oil or the solid lubricants are blended directly with the base oil to form a lubricating composition.

14 Claims, No Drawings

SOLID LUBRICANT BLENDS FOR USE IN LUBRICATING COMPOSITIONS

This application is a continuation-in-part of prior application Ser. No. 13/775,573, filed Feb. 25, 2013.

FIELD OF THE INVENTION

This invention relates to a blend of solid lubricants effective at extreme temperatures and pressure use conditions. More particularly, the invention relates to lubricant additive concentrates and lubricating compositions, each comprising first stage, second stage, and third stage solid lubricants.

BACKGROUND OF THE INVENTION

Lubricating compositions are widely used in industrial and commercial applications. They are used whenever two or more solid surfaces move in close contact. Examples of the several uses include gasoline engines, diesel engines, motors of all sorts, gasoline and steam turbines, gearboxes, bearings, hydraulic pumps, compressors, air operated nail guns and electric saws. A base oil is the major component of the lubricating compositions. One base oil is a mineral oil produced by refining crude oil. Synthetic oils are increasingly becoming a more commonly used base oil. The synthetic oils are produced through chemical synthesis. They typically are polyalphaolefins, esters such as diesters, polyesters, polyolesters, alkylated napthalenes, alkylated benzenes, etc., or hydrocracked/hydroisomerized mineral oils. Semi-synthetic base oils are also available. They are simply blends of mineral oil and synthetic oil.

It is very common to add one or more performance additives to a base oil depending on the base oil's use. Thus, detergents are added for a cleaning effect, anti-rust agents for alleviating corrosion, anti-oxidants to prolong the base oil's life, and others. Enhancing the inherent lubrication effect of base oils is always a desired objective given the fact the better the lubricating property of the base oil, the longer the life of any engine or other mechanical device and the more operation efficiency. Each benefit provides a lower cost of operation. The need for enhanced lubrication is particularly noted under heavy work loads that increase the base oil's operating temperature and performance. For example, race cars running at high speeds require base oils that effectively operate at temperatures up to about 2100 degrees Fahrenheit and extreme pressures. Certain industrial equipment with heavy work loads also experience high temperatures and pressures during use that challenge known lubrication compositions.

In accord with a need, there has been developed a lubricity enhancer which allows a base oil to withstand excessive temperatures and pressures. The enhancer is a blend of components that function effectively at normal operating conditions as well as extreme operating conditions.

SUMMARY OF THE INVENTION

A lubricity enhancer at extreme use temperatures and pressures comprises a first stage solid lubricant effective at low temperatures, a second stage solid lubricant effective at medium temperatures and a third stage solid lubricant effective at high temperatures and pressures. The lubricity enhancer is used in a lubricant additive concentrate with a liquid carrier or is used in a lubricating composition with a base oil. The compositions all comprise a first stage solid lubricant selected from the group consisting of molybdenum disulfide, graphite, polytetrafluorethylene and mixtures thereof, a second stage solid lubricant selected from the group consisting of boron nitride, tungsten disulfide and mixtures thereof, and a third stage solid lubricant of an inorganic fluoride.

DETAILED DESCRIPTION OF THE INVENTION

The compositions of the invention comprise a solid lubricant blend which enhances the lubricity of lubricating compositions at extreme temperatures and pressure use conditions as well as reduces friction, wear and galling. The solid lubricants are blended into lubricant additive concentrates as well as lubricating compositions ready for use. The paragraphs which follow describe in detail the solid lubricants, lubricant additive concentrates containing the solid lubricants, lubricating compositions containing the solid lubricants, and various uses for the compositions. All percentages stated are on a weight basis.

The lubricants comprise a blend of three classes of solid lubricants in specified amounts, which collectively provide lubricity over a wide range of temperatures. The blend comprises a first stage solid lubricant, a second stage solid lubricant and a third stage solid lubricant.

The first stage solid lubricant is effective as a lubricant at a low temperature of about −40 degrees Fahrenheit to about 700 degrees Fahrenheit. It is selected from the group consisting of molybdenum disulfide, graphite, polytetrafluorethylene and mixtures thereof. Such materials are generally recognized as having a lubricating characteristic. They are widely used and are commercially available. Particle size of the first stage solid lubricant, as well as the second and third stage solid lubricants, is important for the end user of the compositions. The first stage solid lubricant must have a particle size less than about 30 microns, primarily because most filters in use filter out larger particles as an impurity. A preferred particle size is less than about 10 micron while a more preferred size ranges from about 0.25 microns to about 1 micron. Molybdenum disulfide is preferred because of cost, ready availability in proper micron size, high operating temperature capability and overall long term performance. A molybdenum disulfide and graphite mixture in a ratio of about 3:7 to about 7:3 is also preferred for the synergistic lubricity effect the mixture provides.

The second stage solid lubricant is selected from the group consisting of boron nitride, tungsten disulfide and mixtures thereof. They also are recognized as having a lubricating characteristic and are available commercially. The second stage solid lubricant is effective as a lubricant within a temperature range from about −40 degrees Fahrenheit to about 1500 degrees Fahrenheit. It primarily provides a bridging effective between the first stage solid lubricant and the below discussed third stage solid lubricant. Its particle size is less than about 30 microns. Preferably, the particle size of the boron nitride and tungsten disulfide is less than about 10 microns and more preferably ranges from about 0.5 microns to about 5 microns.

The third stage solid lubricant is an inorganic fluoride characterized as being able to form a substantially homogeneous film on a substrate at elevated temperatures and pressures. Further the homogeneous film is bonded to the substrate contacted by the third stage lubricant when at the elevated temperatures and pressures. The elevated temperatures at which the third stage solid lubricant functions as a lubricant is from its softening point to about 2100 degrees Fahrenheit. The softening point is dependent on heat and pressure during use. For uses contemplated, the softening point of the third stage lubricant is about 1400 degrees Fahrenheit. Importantly, it begins to function as a lubricant where the first and second stage lubricants begin to fail. Such extremes are reached by lubricating compositions in engines of automobiles, especially high performance race cars and certain industrial machines. The particle size of the third stage solid lubricant is less than about 30 microns. Preferably, it is less than about 10 microns. More preferably, the particle size ranges from about 0.5 microns to about 5 microns.

It has been found that the lubricating function of the third stage component is created by a combination of heat and pressure. With sufficient pressure, heat is generated, and at a point well below the melting point of the third stage lubricant, it will begin to soften. This soft condition allows it to be smeared by pressure to create a substantially homogeneous film on the working surfaces of the engine or other mechanical device. The film bonds to working surfaces and acts as a friction reducer. The film will eventually rub off as it hardens with a drop in friction and heat. The remaining third stage lubricant can reform the film if the extreme temperature and pressure conditions occur again.

Inorganic fluorides suitable for use include calcium fluoride, barium fluoride, lithium fluoride, magnesium fluoride, and mixtures thereof. These materials are widely known, though are not regarded as lubricants in the compositions contemplated by this invention. Calcium fluoride is preferred because of cost, stability and safety reasons.

A blend of the solid lubricants is incorporated into a liquid carrier to produce the lubricant additive concentrate. The concentrate is then added by the end user to a base oil for ultimate use as the lubricating composition. The concentrate comprises from about 3% to about 50% of the first stage solid lubricant, about 0.3% to about 10% of the second stage solid lubricant, about 0.6% to about 20% of the third stage solid lubricant and the balance a liquid carrier. The liquid carrier includes any carrier that is blended with the solid lubricant for packaging, mixing, or any other commercial purpose. There are numerous liquid carriers suitable for the purposes of this invention. Examples include, but are not limited to, polyalpholefins, polyolmonoesters, and multiesters, a base oil and mixtures thereof. The base oil is a refined mineral crude oil, a synthetic oil, or a mixture thereof. It can be and, in fact preferably, is the same as the base oil to which the lubricant additive concentrate is added. A preferred additive concentrate of the invention comprises from about 10% to about 40% of the first stage solid lubricant from about 1% to about 2.5% of the second stage solid lubricant, from about 2% to about 3% of the third stage solid lubricant and from about 30% to about 85% of the liquid carrier.

A ready to use lubricating composition of the invention is useful wherever lubricating compositions are currently used, but is of most use in a high performance environment where lubricity at extreme temperatures and pressure conditions are likely to be encountered. The lubricating compositions comprise from about 1% to about 7%, preferably about 1.8% to about 5% of the first stage solid lubricant, from about 0.03% to about 5%, preferably about 0.5% to about 3% of the second stage solid lubricant, from about 0.3% to about 10%, preferably about 0.5% to about 8% of the third stage solid lubricant and the balance a base oil, preferably in an amount of about 85% to about 97%. Base oils are described below.

Base oils typically are defined as an oil with a boiling point between 550 and 1050 degrees Fahrenheit and consisting of between 18 to 40 carbon atoms. They are either a mineral oil, a synthetic oil or a mixture thereof. Such oils are widely used. Mineral base oils are derived from crude oil that has been refined to remove unwanted fractions such as gasoline, waxes, etc. Synthetic base oils are made by chemical processes that are chemically designed to give products with properties not found in the mineral base oils, e.g. heat resistance. Base oils useful in the compositions are found in U.S. Pat. No. 8,354,566, Col. 13, line 32 to Col. 15, line 37, the disclosure of which is hereby incorporated by reference. In particular, examples of mineral oils are given in Col. 13, lines 62-67. Examples of synthetic oils are given in Col. 14, line 1 to Col. 15, line 6.

In accord with this invention, a blend of the solid lubricants discussed above is mixed either with a liquid carrier or with the base oil in the proportions discussed above. The solid lubricants can be preblended and added to either the liquid carrier of the lubricant additive concentrates or the base oil of the lubricating compositions. The solid lubricants can be added one at a time if desired. They can as well be individually or collectively dispersed in a liquid prior to adding to any base oil. As evident, formulators of the compositions of the invention have wide latitude in how the solid lubricants are incorporated into a formulation.

Any of several known additives commonly added to base oils which are compatible with the solid lubricants of the invention are used. Such additives include dispersants, detergents, friction modifiers, anti-wear agents, antioxidants, antifoaming agents, viscosity index improvers, rust inhibitors, dehazing agents, demulsifying agents, and metal deactivating agents. U.S. Pat. Nos. 7,482,312 and 8,354,566 are incorporated by reference. In particular, Col. 9, line 56 to Col. 12, line 55 of the U.S. Pat. No. 7,482,312 contains several examples of additives as does Col. 15, line 54 to Col. 16, line 37 of the U.S. Pat. No. 8,354,566. The additives are used in functionally effective amounts to get the desired benefit.

Of particular interest, an abrasive additive having a particle size less than about 4 microns and a melting point greater than about 3,000 degrees Fahrenheit is added. The abrasive is selected from the group consisting of mica, silica, aluminum oxide, diamond dust, and mixtures thereof and is included in the lubricating composition at a level of from about 0.21% to about 2.0%. It has been found the abrasive additive cleans the engine or other mechanical product during use and is able to withstand the temperatures and pressures the compositions of this invention are designed to handle.

The examples which follow are representative formulations of lubricant additive concentrates and lubricating compositions. Examples 1-4 illustrate the lubricant additive concentrates while Examples 5 and 6 illustrate the lubricating compositions.

Example 1

This example illustrates a basic lubricant additive concentrate.

| Component | Wt. % | Particle Size (microns) |
|---|---|---|
| Molybdenum Disulfide (Moly) | 12.00 | <1 |
| Mineral Oil Carrier | 46.00 | |
| Boron Nitride | 0.60 | ≤4 |
| Calcium Fluoride | 2.00 | ≤4 |
| Dispersant/Suspension Agent (1) | 0.42 | |
| Polyalphaolefin (PAO) Carrier | 38.98 | |
| | 100.00 | |

(1) Available from Afton Chemical Company as HiTec 644

The molybdenum disulfide is commercially available as a colloidal suspension of solids in the mineral oil. The suspension is first blended with the boron nitride and calcium fluoride solids. The resultant mixture is then blended with the PAO carrier and dispersant to produce the lubricant additive concentrate. The concentrate is formulated so that one oz. of it added to one quart of oil provides enhanced lubricity at extreme operating temperatures and pressures.

Example 2

A lubricant additive concentrate containing a blend of the first stage solid lubricant is illustrated.

| Component | Wt. % | Particle Size (microns) |
|---|---|---|
| Molybdenum Disulfide | 12.00 | <1 |
| Mineral Oil Carrier | 46.00 | |
| Graphite | 6.00 | 1 |
| Boron Nitride | 1.00 | ≤4 |
| Calcium Fluoride | 3.00 | ≤4 |
| Dispersant/Suspension Agent (1) | 0.42 | |
| PAO Carrier | 31.58 | |
| | 100.00 | |

(1) Available from Afton Chemical Company as HiTec 644

The graphite, boron nitride, and calcium fluoride are blended in any order with a suspension of the molybdenum disulfide in the mineral oil. The PAO carrier and dispersant are then added to result in the lubricant additive concentrate. The benefit obtained from using the two first stage solid lubricants of graphite and molybdenum is enhanced lubricity due to a synergistic effect of the two components.

Example 3

A preferred lubricant additive concentrate of the invention is now illustrated.

| Component | Wt. % | Particle Size (microns) |
|---|---|---|
| Molybdenum Disulfide | 12.00 | <1 |
| Mineral Oil Carrier | 46.00 | |
| Boron Nitride | 0.60 | ≤10 |
| Lithium Fluoride | 2.00 | ≤20 |
| Dispersant/Suspension Agent (1) | 0.42 | |
| Group III Synthetic Oil Carrier | 38.98 | |
| | 100.00 | |

(1) Available from Afton Chemical Company as HiTec 644

The molybdenum disulfide suspension and the balance of the composition are blended together in any order of component addition.

Example 4

This example illustrates a simple blend of the first, second, and third stage solid lubricants of the invention together with a semi-synthetic oil to produce another lubricant additive concentrate.

| Component | Wt. % | Particle Size (microns) |
|---|---|---|
| Molybdenum Disulfide | 12.00 | <1 |
| Boron Nitride | 0.60 | ≤4 |
| Calcium Fluoride | 1.20 | ≤4 |

-continued

| Component | Wt. % | Particle Size (microns) |
|---|---|---|
| Dispersant/Suspension Agent (1) | 1.44 | |
| Group III Semi-Synthetic Oil Carrier | 84.76 | |
| | 100.00 | |

(1) Available from Afton Chemical Company as HiTec 644

Example 5

A lubricating composition is illustrated in this example.

| Component | Wt. % | Particle Size (microns) |
|---|---|---|
| Molybdenum Disulfide | 2.00 | <10 |
| Mineral Oil Carrier | 2.09 | |
| Boron Nitride | 0.16 | ≤20 |
| Calcium Fluoride | 0.33 | ≤20 |
| Dispersant/Suspension Agent (1) | 0.07 | |
| Antioxidant (2) | 0.50 | |
| Friction Modifier (3) | 0.14 | |
| Viscosity Index Improver (4) | 6.40 | |
| Group III Mineral Base Oil | 88.31 | |
| | 100.00 | |

(1) Available from Afton Chemical Company as HiTec 644
(2) Available from Ciba Specialty Chemicals as IRGANOX L64
(3) Available from Chemtura Corp. as NAUGALUBE 810
(4) Available from Infinies as SV205

The composition is formulated by first blending the three solid lubricants together and then blending the resultant mixture with the mineral base oil.

Example 6

The following lubricating composition includes a silica abrasive for engine cleaning purposes.

| Component | Wt. % | Particle Size (microns) |
|---|---|---|
| Molybdenum Disulfide | 2.00 | <1 |
| Mineral Oil Carrier | 2.50 | |
| Boron Nitride | 0.16 | ≤4 |
| Calcium Fluoride | 0.33 | ≤4 |
| Silica | 0.02 | <1 |
| Dispersant/Suspension Agent | 0.14 | |
| Antioxidant | 0.50 | |
| Friction Modifier | 0.14 | |
| Viscosity Modifier | 6.40 | |
| Group III Synthetic Base Oil | 87.81 | |
| | 100.00 | |

The dispersant, antioxidant, friction modifier, and viscosity modifier are the same as described in Example 5.

Having described the invention in its preferred embodiment, it should be clear that modifications can be made without departing from the spirit of the invention. It is not intended that the words used to describe the invention be limiting on the invention. It is intended that the invention only be limited by the scope of the appended claims.

I claim:

1. A lubricant additive concentrate for enhancing lubricity of a lubricating composition at extreme use conditions, said lubricant additive concentrate consisting essentially of:

(a) from about 3% to about 50% of a first stage solid lubricant effective at low temperatures, said first stage solid lubricant having a particle size less than about 30 microns and being molybdenum disulfide;

(b) from about 0.3% to about 10% of a second stage medium temperature solid lubricant effective at medium temperatures, said second stage solid lubricant having a particle size less than about 30 microns and being boron nitride;

(c) from about 0.6% to about 20% of a third stage high temperature solid lubricant effective at high temperatures and high pressures, said third stage solid lubricant having a particle size less than about 30 microns and being an inorganic fluoride characterized by being capable of forming a bondable substantially homogeneous film on a substrate at elevated temperatures and selected from the group consisting of calcium fluoride, lithium fluoride, magnesium fluoride, and mixtures thereof; and (d) the balance a liquid carrier compatible with a lubricating composition.

2. The lubricant additive concentrate of claim 1 wherein the first stage solid lubricant has a particle size less than about 10 micron, the second stage solid lubricant has a particle size less than about 10 microns and the third state solid lubricant has a particle size less than about 10 microns.

3. The lubricant additive concentrate of claim 2 further wherein the first stage solid lubricant has a particle size of from about 0.25 microns to about 1 micron, the second stage solid lubricant has a particle size of about 0.5 microns to about 5 microns and the third state solid lubricant has a particle size of from about 0.5 microns to about 5 microns.

4. The lubricant additive concentrate of claim 1 wherein the liquid carrier is a base oil, a polyalphaolefin, a polyol monoester, a multiester, or a mixture thereof.

5. The lubricant additive concentrate of claim 1 wherein the liquid carrier is a base oil.

6. The lubricant additive concentrate of claim 4 wherein the third stage solid lubricant is calcium fluoride.

7. The lubricant additive concentrate of claim 1 consisting essentially of:

(a) from about 10% to about 40% of the first stage solid lubricant molybdenum disulfide;

(b) from about 1% to about 2.5% of the second stage solid lubricant boron nitride;

(c) from about 2% to about 3% of the third stage solid lubricant calcium fluoride; and (d) from about 30% to about 85% of the liquid carrier.

8. The lubricant additive concentrate of claim 1 wherein the first stage solid lubricant effectively functions as a lubricant within the temperature range of from about −40 degrees Fahrenheit to about 700 degrees Fahrenheit, the second stage solid lubricant effectively functions as a lubricant within the temperature range of from about −40 degrees Fahrenheit to about 1500 degrees Fahrenheit, and the third stage solid lubricant effectively functions as a lubricant within the temperature range of from about 1500 degrees Fahrenheit to about 2100 degrees Fahrenheit.

9. A lubricating composition having lubricity at extreme use conditions consisting essentially of:

(a) from about 1% to about 7% of a first stage solid lubricant effective at low temperatures, said first stage solid lubricant having a particle size less than about 30 microns and being molybdenum disulfide;

(b) from about 0.03% to about 5% of a second stage medium temperature solid lubricant effective at medium temperatures, said second stage solid lubricant having a particle size less than about 30 microns and being boron nitride;

(c) from about 0.3% to about 10% of a third stage high temperature solid lubricant effective at high temperatures, said third stage solid lubricant having a particle size less than about 30 microns and being an inorganic fluoride characterized by being capable of forming a bondable substantially homogeneous film on a solid substrate at elevated temperatures and selected from the group consisting of calcium fluoride, lithium fluoride, magnesium fluoride, and mixtures thereof; and (d) the balance a base oil.

10. The lubricating composition of claim 9 wherein the first stage solid lubricant has a particle size less than about 10 micron, the second stage solid lubricant has a particle size less than about 10 microns and the third stage solid lubricant has a particle size less than about 10 microns.

11. The lubricating composition of claim 10 wherein the first stage solid lubricant has a particle size of from about 0.25 microns to about 1 micron, the second stage solid lubricant has a particle size of about 0.5 microns to about 5 microns and the third state solid lubricant has a particle size of from about 0.5 microns to about 5 microns.

12. The lubricating composition of claim 11 consisting essentially of from about 1.8% to about 5% of the first stage lubricant, about 0.5% to about 3% of the second stage lubricant, from about 0.5% to about 8% of the third state stage lubricant and from about 85% to about 97% of the base oil.

13. The lubricating composition of claim 12 wherein the third stage solid lubricant is calcium fluoride.

14. A lubricating composition having lubricity at extreme use conditions consisting essentially of:

(a) from about 1% to about 7% of a first stage molybdenum disulfide solid lubricant effective at low temperatures, said first stage solid lubricant having a particle size less than about 30 microns;

(b) from about 0.03% to about 5% of a second stage boron nitride solid lubricant effective at medium temperatures, said second stage solid lubricant having a particle size less than about 30 microns;

(c) from about 0.3% to about 10% of a third stage calcium fluoride solid lubricant effective at high temperatures, said third stage solid lubricant having a particle size less than about 30 microns and characterized by being capable of forming a bondable substantially homogeneous film on a solid substrate at elevated temperatures; and (d) the balance a base oil.

* * * * *